US006896561B2

(12) United States Patent
Lai

(10) Patent No.: US 6,896,561 B2
(45) Date of Patent: May 24, 2005

(54) LEAD-WIRE TERMINALS OF ALL-IN-ONE CARD CONNECTOR

(75) Inventor: Yaw-Huey Lai, Taipei Hsien (TW)

(73) Assignee: Tai-Sol Electronics Co., Ltd., Taipei Hsien (TW)

( * ) Notice: Subject to any disclaimer, the term of this patent is extended or adjusted under 35 U.S.C. 154(b) by 0 days.

(21) Appl. No.: 10/714,971

(22) Filed: Nov. 18, 2003

(65) Prior Publication Data

US 2005/0085140 A1 Apr. 21, 2005

(30) Foreign Application Priority Data

Oct. 16, 2003 (TW) ..... 92218431 U

(51) Int. Cl.[7] ..... H01R 4/48
(52) U.S. Cl. ..... 439/862; 439/74
(58) Field of Search ..... 439/862, 74

(56) References Cited

U.S. PATENT DOCUMENTS 4,245,876 A * 1/1981 Ritchie et al. ..... 439/590
4,555,151 A * 11/1985 Neese et al. ..... 439/82
4,647,126 A * 3/1987 Sobota, Jr. ..... 439/74

* cited by examiner

*Primary Examiner*—Gary Paumen
*Assistant Examiner*—James R. Harvey
(74) *Attorney, Agent, or Firm*—Bacon & Thomas, PLLC

(57) ABSTRACT

Lead-wire terminals each are formed of an electroconductive curvy wire. The curvy wire includes a first U-shaped yoke, a second U-shaped yoke, a connecting potion connected between the first and second yokes, and a contact portion extending downwards and then parallel from a distal end of the second yoke, wherein each of the first and second yokes has an opening facing towards the same direction. Accordingly, the two yokes clamp the card connector by the two yokes to be securely positioned on the card connector.

6 Claims, 7 Drawing Sheets

LEAD-WIRE TERMINALS OF ALL-IN-ONE CARD CONNECTOR

BACKGROUND OF THE INVENTION

1. Field of the Invention

The present invention relates generally to electronic devices, and more particularly to lead-wire terminals of an all-in-one card connector.

2. Description of the Related Art

A conventional all-in-one card connector is composed of two circuit boards closely mounted to bilateral sides of a card guide member. Each of the two circuit boards includes a plurality of contact pins for contacting contact pads of different kinds of electronic memory cards and a plurality of lead wires electrically extending to a rear edge thereof for electrically connecting other external circuit boards.

When the aforementioned all-in-one card connector is connected with the external circuit board, it is usually to put the card connector on the external circuit board; meanwhile, one of the circuit boards (top circuit board) of the card connector is closely mounted on the external circuit board, and the other (bottom circuit board) is spaced apart from the external circuit board and therefore needs metallic lead-wire terminals extending downwards to be connected with the external circuit board. However, when the lead-wire terminals extend downwards to be connected with the external circuit board, distal ends of the terminals are not secured to be subject to shaking by an external force during the process of soldering. In addition, it is difficult to manipulate the precision of the distal ends of the terminals to dispose more terminals within limited space, such that the terminals have to be additionally disposed on bilateral sides of the top circuit board of the card connector to be more received, which causes poor soldering during the process of soldering in tin furnace to further incur low yield factor.

SUMMARY OF THE INVENTION

The primary objective of the present invention is to provide lead-wire terminals of an all-in-one card connector, which are preferably stabilized and can be more disposed within limited space.

The secondary objective of the present invention is to provide lead-wire terminals of an all-in-one card connector, which are disposed merely on a rear end but additionally on bilateral sides of the card connector to facilitate the soldering.

The foregoing objectives of the present invention are attained by the lead-wire terminals, each of which is formed of an electroconductive curvy wire. The curvy wire includes a first U-shaped yoke, a second U-shaped yoke, a connecting potion connected between the first and second yokes, and a contact portion extending downwards and then parallel from a distal end of the second yoke, wherein each of the first and second yokes has an opening facing towards the same direction. Accordingly, the two yokes clamp the card connector by the two yokes to be securely positioned on the card connector.

DETAILED DESCRIPTION OF THE INVENTION

Figure 1:
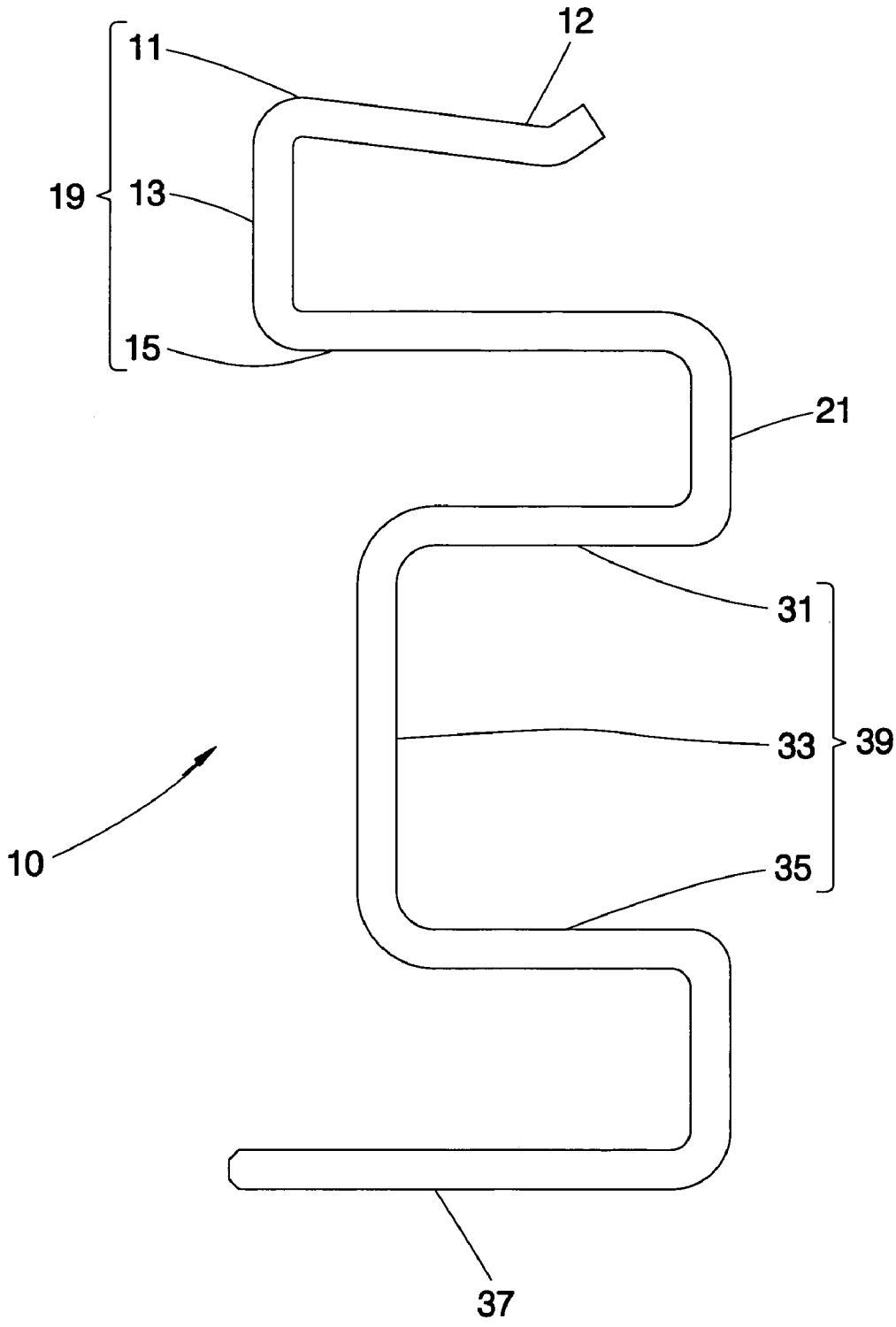
FIG. 1 is a side view of a preferred embodiment of the present invention.

Referring to FIG. 1, lead-wire terminals 10 are constructed according to a preferred embodiment of the present invention and adapted to be mounted on an all-in-one card 41. Each of the lead-wire terminals 10 is formed of a one-piece electroconductive curvy wire and includes a substantially parallel solderable portion 11, a slope portion 12 extending towards the lower-right from a right distal end of the solderable portion 11 and having a turnup distal end towards the upper-right, a first upright portion 13 extending downwards from a left distal end of the slope portion 12, a first recurvature portion 15 extending rightwards from a bottom end of the first upright portion 13, a connecting portion 21 extending downwards from a right distal end of the first recurvature portion 15, a second recurvature portion 31 extending leftwards from a bottom end of the connecting portion 21, a second upright recurvature portion 33 extending downwards from a left distal end of the second recurvature portion 31, a third recurvature portion 35 extending rightwards from a bottom end of the second upright recurvature portion 33, and a contact portion 37 extending downwards and then leftwards from a distal end of the third recurvature portion 35. The solderable portion 11, the first upright portion 13, and the first recurvature portion 15 together define a first U-shaped yoke 19. The second recurvature portion 31, the second upright recurvature portion 33, and the third recurvature portion 35 together define a second U-shaped yoke 39. Each of the first and second U-shaped yokes has an opening facing towards the same direction. The opening of the second U-shaped yoke 39 is larger than that of the first U-shaped yoke 19. The contact portion 37 is adapted for electrically connecting an external circuit board (not shown).

Figure 2:
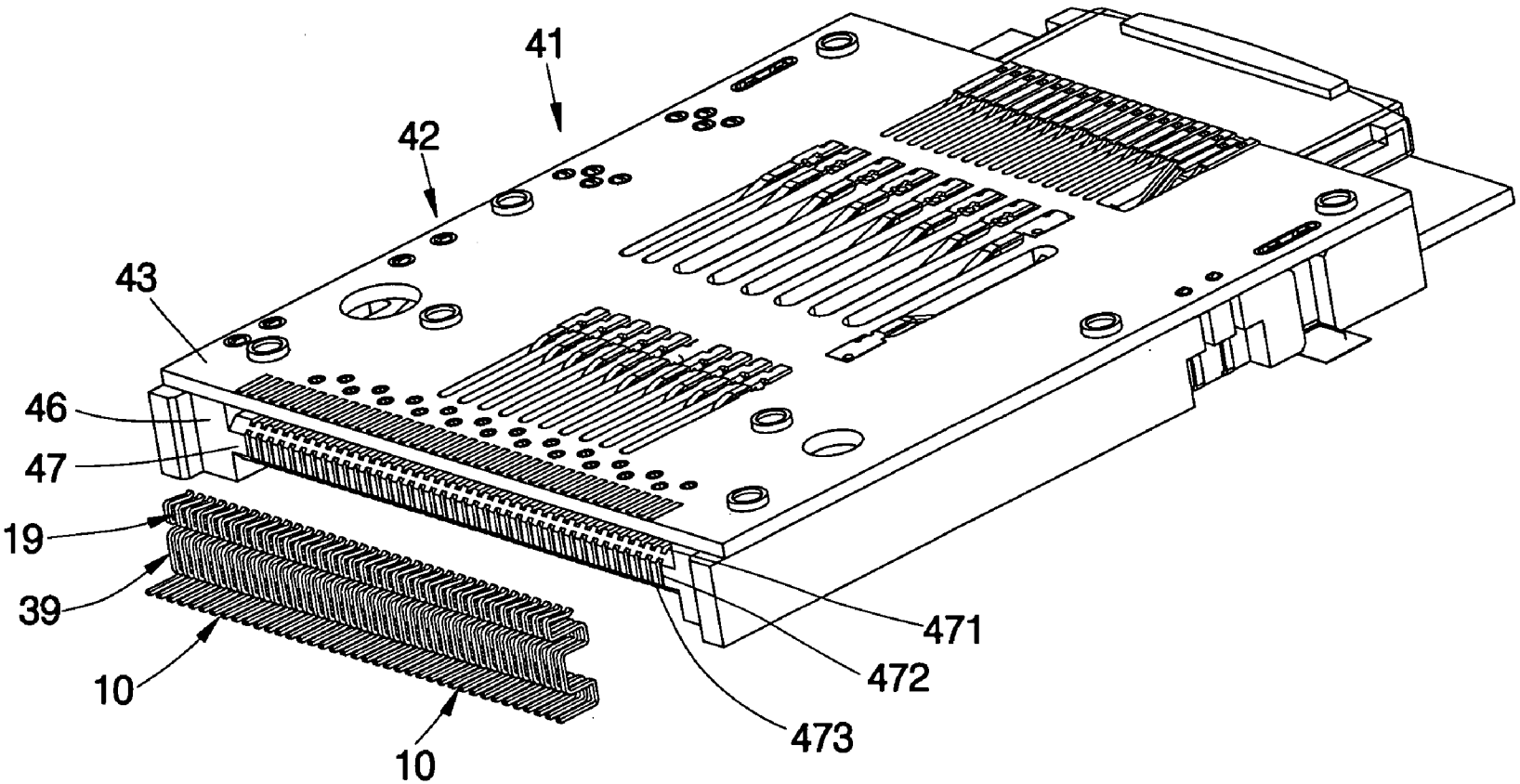
FIG. 2 is a perspective view of the preferred embodiment of the present invention to be mounted on a card connector.
Figure 3:
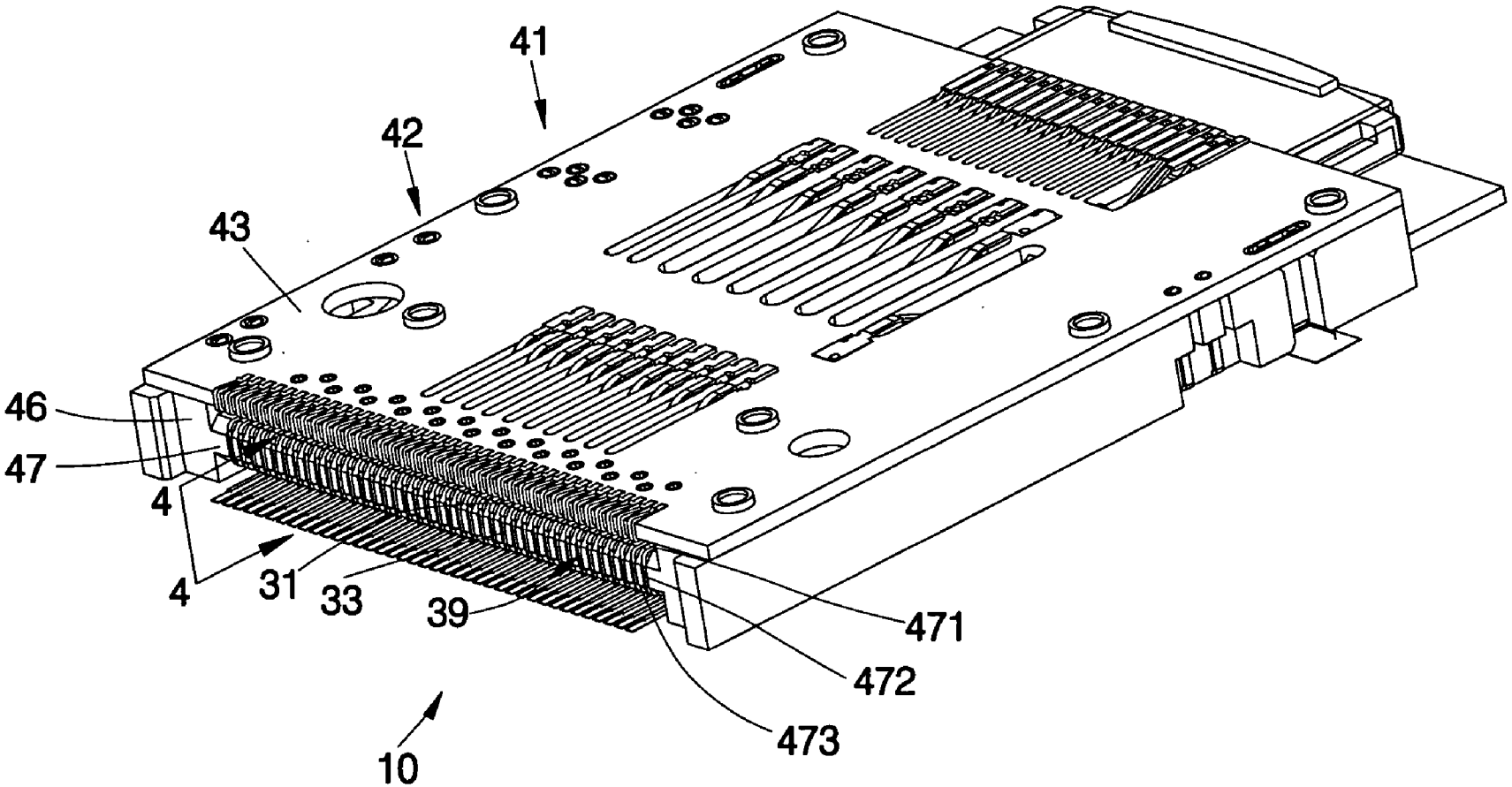
FIG. 3 is a perspective view of the preferred embodiment of the present invention mounted on the card connector.
Figure 4:
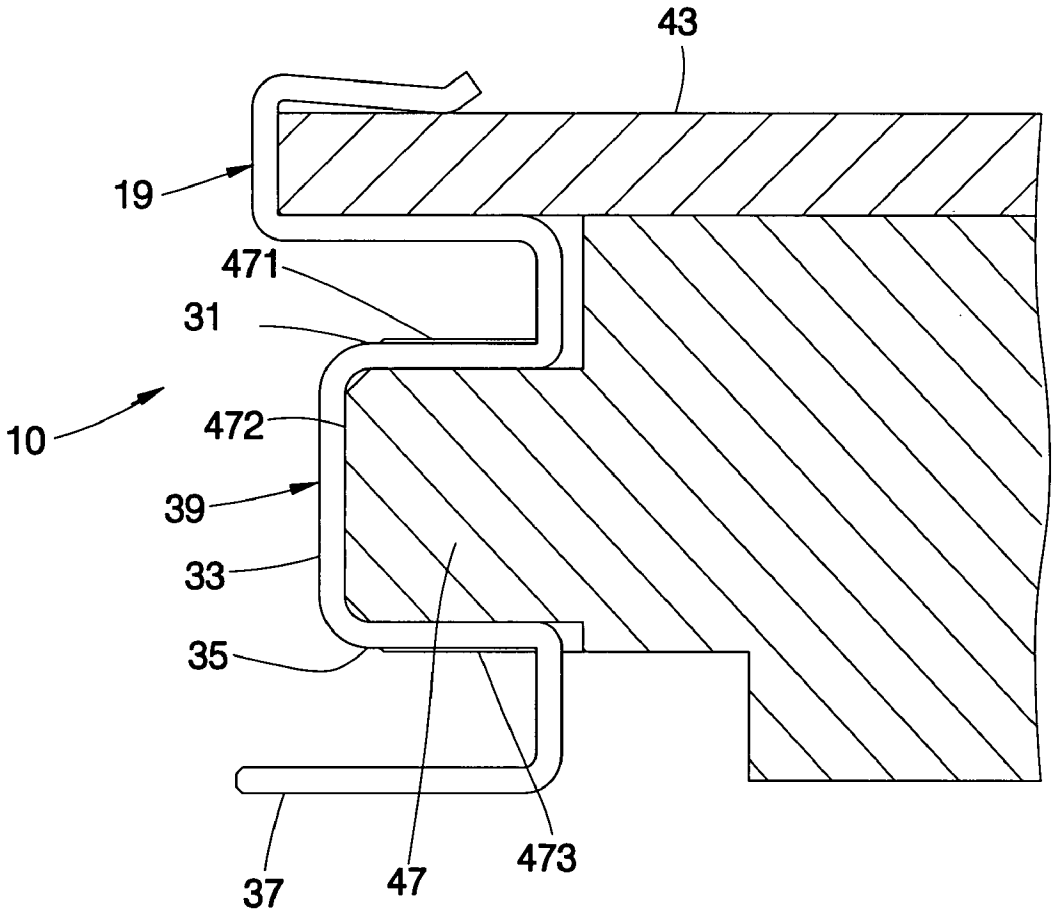
FIG. 4 is a sectional view taken by a line 4—4 indicated in FIG. 3.

Referring to FIGS. 2 and 3, a plurality of lead-wire terminals 10 of the present invention are mounted on a base frame 42 of a card connector 41. The base frame 42 is composed of a card guide member 46 and a circuit board 43 mounted on a top side of the card guide member 46 for inserting various kinds of electronic memory cards. The card guide member 46 includes an elongated butt portion 47 at a rear end thereof and a plurality of upper nicks 471, intermediate nicks 472, and lower nicks 473. When the lead-wire terminals 10 are mounted to the rear end of the base frame 42, the first yoke 19 is aligned with the circuit board 43 and the second yoke 39 is aligned with the butt portion 47 of the card guide member 46. The lead-wire terminals 10 are pushed towards the rear end of the base frame 42 to enable the first yoke 19 to clamp the circuit board 43, as shown in FIGS. 3 and 4, and the second yoke 39 to clamp the butt portion 47, and meanwhile, to enable the second recurvature portion 31 to be embedded into the upper nicks 471, the second upright portion 33 to be embedded into the intermediate nicks 472, and the third recurvature portion 35 to be embedded into the lower nicks 473. As shown in FIG. 4, the upper and intermediate and lower nicks 471, 472, and 473 not only clamp but also securely position the second recurvature portion 31, the second upright portion 33, and the third recurvature portion 35 to stably position the contact portion 37, such that the contact portion 37 is not subject to shaking by an external force. Hence, the precision of the terminals 10 is enhanced to enable more terminals 10 to be received within limited space.

Figure 5:
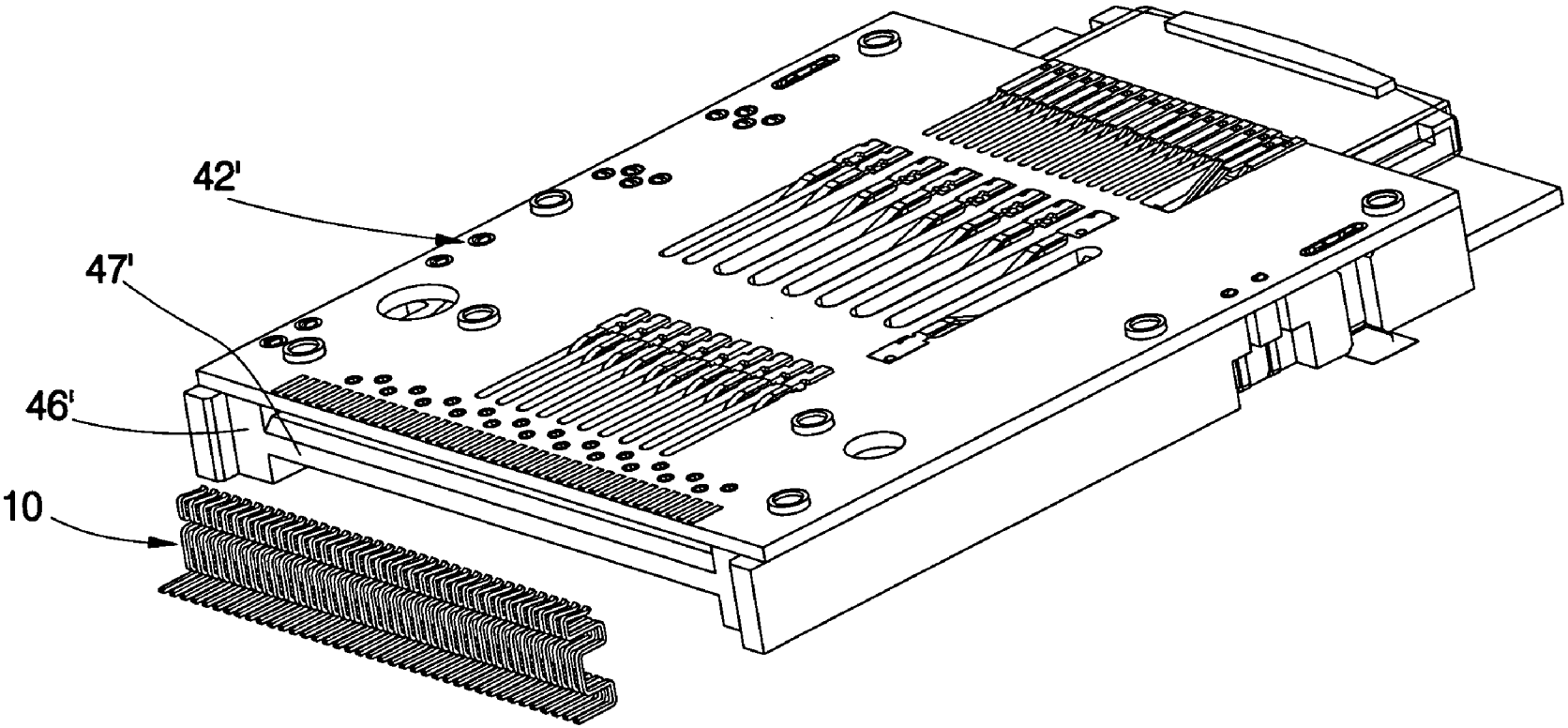
FIG. 5 is a perspective view of the preferred embodiment of the present invention to be mounted on another all-in-one card connector.

Referring to FIG. 5, when the butt portion 47' of the card guide member 46' is bare at surfaces thereof without the nicks disposed thereon, the second yoke 39 still can clamp the butt portion 47' to enable the terminals 10 to be stably secured to the base frame 42'.

Figure 6:
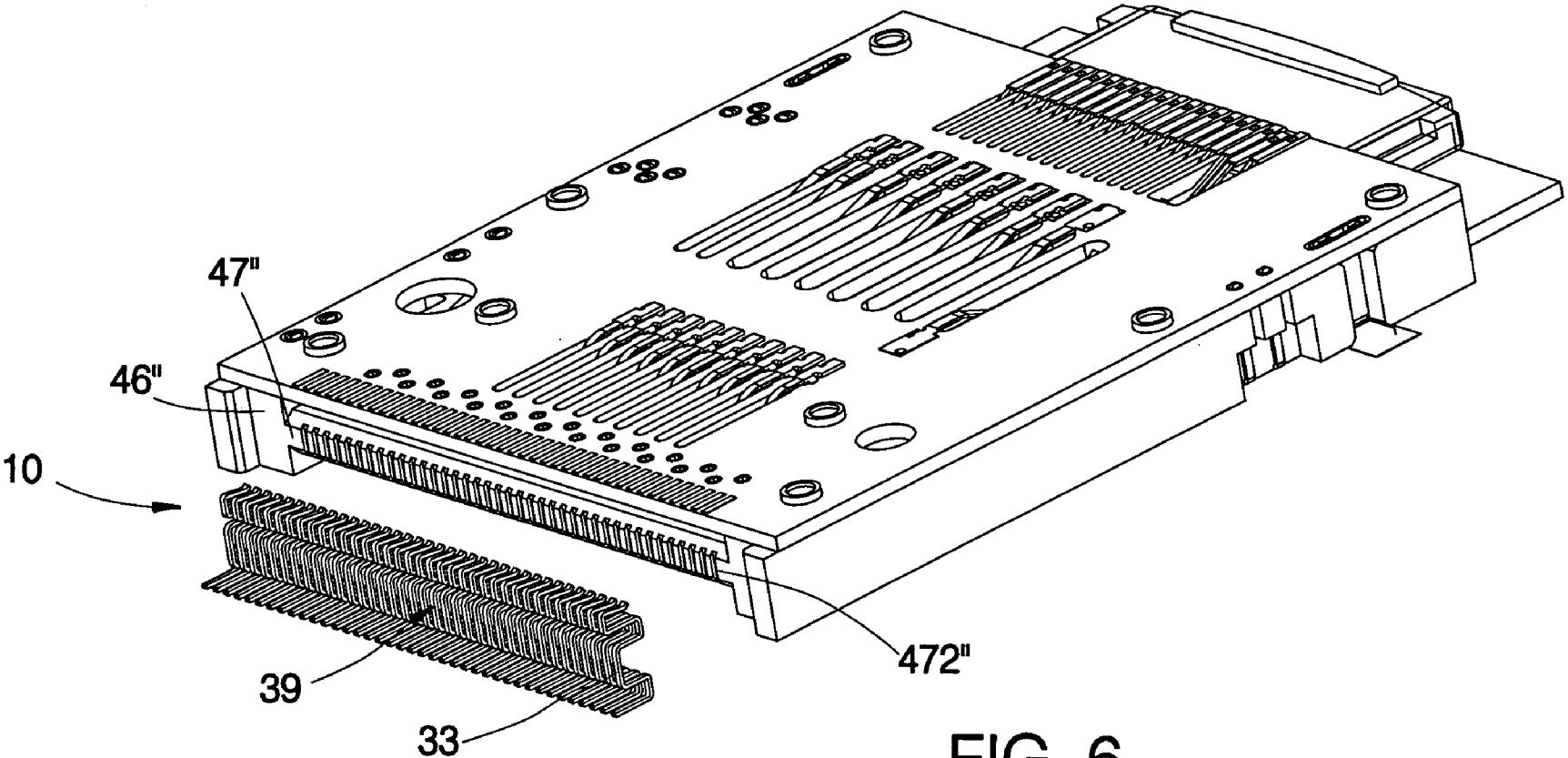
FIG. 6 is a perspective view of the preferred embodiment of the present invention to be mounted on one another all-in-one card connector.

Referring to FIG. 6, when the butt portion 47" of the card guide member 46" is disposed with the intermediate nicks 472" and the second yoke 39 of the terminals 10 clamps the butt portion 47", the second upright portion 33 is embedded into the intermediate nicks 472" to enable the terminals 10 to be also clamped and securely positioned.

Figure 7:
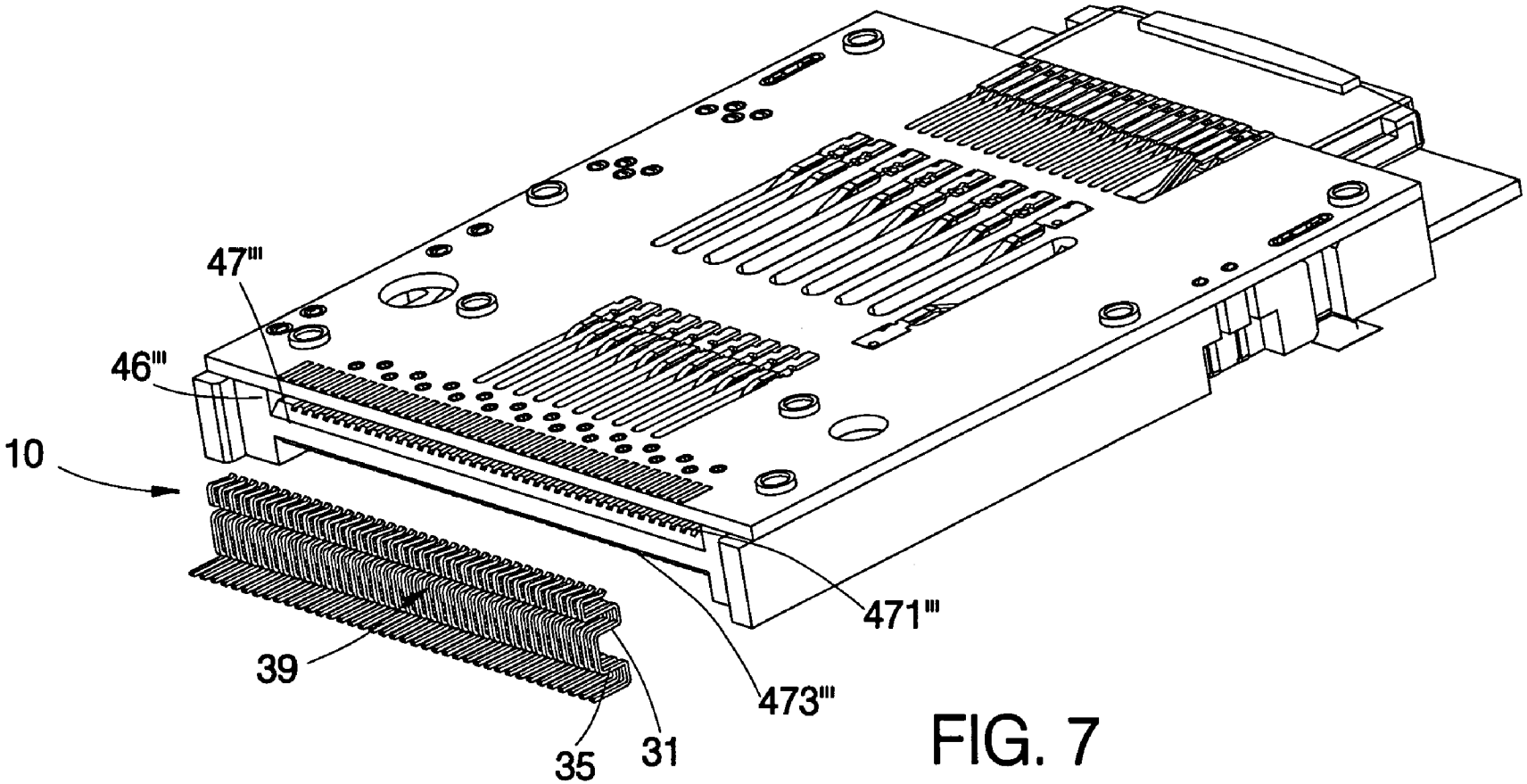
FIG. 7 is a perspective view of the preferred embodiment of the present invention to be mounted on still another all-in-one card connector.

Referring to FIG. 7, when the butt portion 47'" of the card guide member 46'" is disposed with the upper and lower nicks 471'" and 473'" and the second yoke 39 of the terminals 10 clamps the butt portion 47'", the second recurvature portion 31 is embedded into the upper nick 471'" and the third recurvature potion 35 is embedded into the lower nick 473'" to enable the terminals 10 to be also clamped and securely positioned.

In conclusion, the present invention includes advantages as follows.

1. The lead-wire terminals are clamped and securely positioned to prevent from shaking to incur very high precision, such that more terminals can be received within limited space.

2. Pursuant to item 1, the terminals are disposed only on the rear end of the base frame of the card connector, such that it is convenient for the soldering.

What is claimed is:

1. Lead-wire terminals of an all-in-one card connector, said card connector including a card guide member having an elongated portion with a plurality of upper nicks, a plurality of intermediate nicks, and a plurality of lower nicks, and a circuit board mounted on the card guide member, said lead-wire terminals formed of a plurality of one-piece electroconductive curvy wires each comprising a first U-shaped yoke, a second U-shaped yoke, a connecting portion formed between said first and second U-shaped yokes, and a contact portion extending downwards and then parallel from a distal end of said second yoke and adapted to engage an external circuit board, each of said first and second yokes having an opening facing towards the same direction, said first U-shaped yoke clamping said circuit board and said second U-shaped yoke being embedded in said nicks to position said lead-wire terminals and clamp said elongated portion of said card guide member.

2. The lead-wire terminals as defined in claim 1, wherein said first yoke comprises a substantially horizontal solderable portion, a first upright portion extending downwards from a distal end of said solderable portion, and a first recurvature portion extending rightwards from a distal end of said first upright portion.

3. The lead-wire terminals as defined in claim 2, wherein said connecting portion extends downwards from a distal end of said first recurvature portion.

4. The lead-wire terminals as defined in claim 1, wherein said second yoke comprises a second recurvature portion, a second upright portion extending downwards from a distal end of said second recurvature portion, and a third recurvature portion extending rightwards from a distal end of said second upright portion, wherein said second recurvature portion, said second upright portion, and said third recurvature portion are respectively embedded in said upper nicks, said intermediate nicks, and said lower nicks of said elongated portion of the said card guide member.

5. The lead-wire terminals as defined in claim 1, wherein said solderable portion comprises a slope portion having a turnup distal end.

6. The lead-wire terminals as defined in claim 1, wherein the opening of said second yoke is larger than that of said first yoke.

* * * * *